United States Patent [19]

Scampini

[11] Patent Number: 4,818,187

[45] Date of Patent: Apr. 4, 1989

[54] FLUID EXCHANGE PUMP

[76] Inventor: Daniel Scampini, 64B Woodhollow, Twin Lakes Apts., Clifton Park, N.Y. 12065

[21] Appl. No.: 865,369

[22] Filed: May 21, 1986

[51] Int. Cl.[4] ..... F04F 1/06

[52] U.S. Cl. ..... 417/137; 417/143

[58] Field of Search ..... 417/65, 137, 143

[56] References Cited

U.S. PATENT DOCUMENTS

| | | | |
|---|---|---|---|
| 756,968 | 4/1904 | Kirksey | 417/137 |
| 847,508 | 3/1907 | Ralston | 417/137 X |
| 896,581 | 8/1908 | Robinson et al. | 417/137 X |
| 1,005,664 | 10/1911 | Snyder | 417/137 X |
| 1,136,070 | 4/1915 | Weber | 417/143 |
| 1,510,744 | 10/1924 | Gillespie et al. | 417/137 X |
| 1,826,175 | 10/1931 | Hulse | 417/143 X |
| 2,026,226 | 12/1935 | Entrop | 417/143 |
| 3,262,757 | 7/1963 | Bodmer | 417/137 X |
| 3,422,768 | 1/1969 | Repp | 417/143 X |
| 3,676,019 | 7/1972 | Self | 417/137 X |
| 3,930,755 | 1/1976 | Lahr et al. | 417/143 X |
| 4,021,147 | 5/1977 | Brekke | 417/143 X |

FOREIGN PATENT DOCUMENTS

| | | | |
|---|---|---|---|
| 54717 | 11/1933 | Norway | 417/65 |

*Primary Examiner*—Carlton R. Croyle
*Assistant Examiner*—Ted Olds
*Attorney, Agent, or Firm*—Schmeiser, Morelle & Watts

[57] ABSTRACT

A fluid pump which uses a motive fluid for pumping liquid or gaseous fluids by use of a fluid inlet, a fluid exchange chamber, and a fluid exhaust means operates as follows: A fluid which is to be pumped is introduced into a fluid exchange chamber. The exchange chamber then isolates itself from the fluid source. Now a motive fluid is introduced to the exchange chamber. The fluid which is to be pumped is carried away from its intended use while the motive fluid displaces the previously existing fluid in the exchange chamber. The exchange chamber is then exhausted of its motive fluid contents and more fluid which is to be pumped, is once again introduced to the exchange chamber to repeat the cycle.

1 Claim, 8 Drawing Sheets

FIG. 9
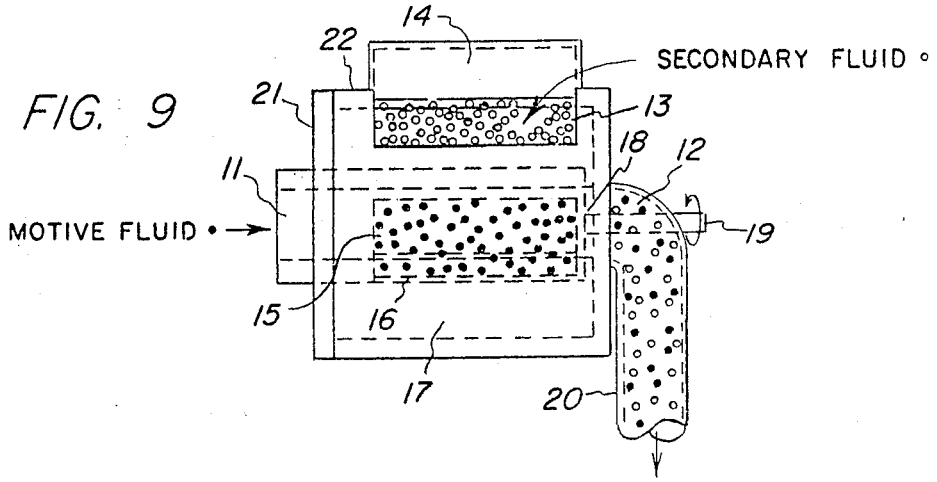
FIG. 9A
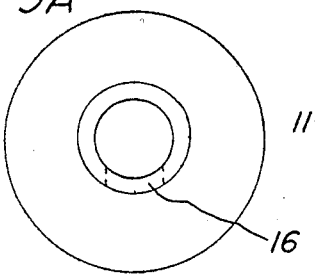
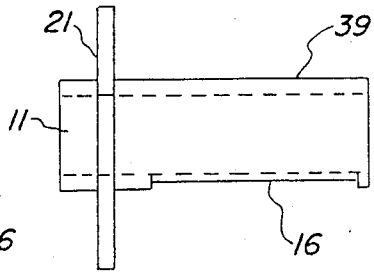
FIG. 9B
FIG. 9C
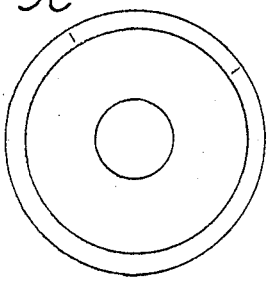
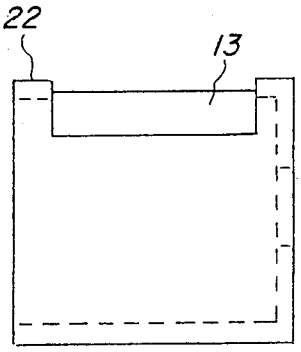
FIG. 9D
FIG. 9E
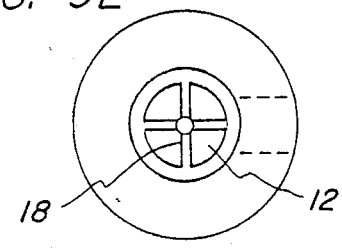
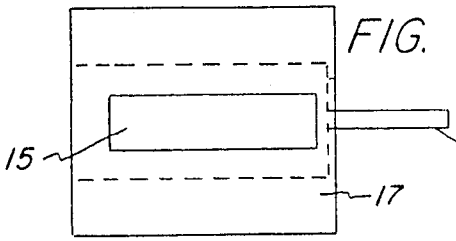
FIG. 9F

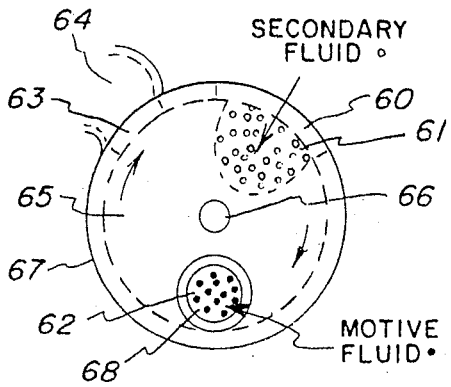
FIG. 23
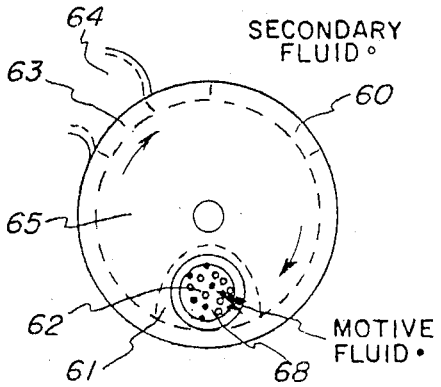
FIG. 24
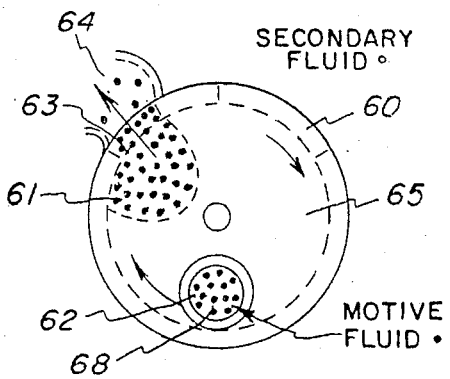
FIG. 25
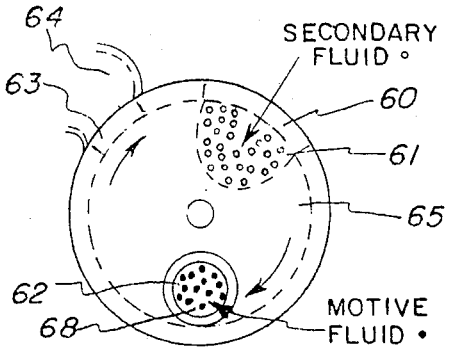
FIG. 26
FIG. 27
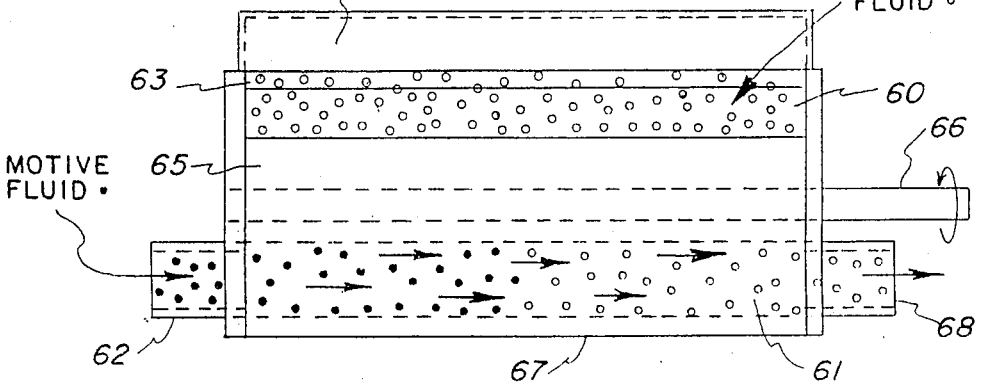

FLUID EXCHANGE PUMP

BACKGROUND OF THE INVENTION

Currently existing pumps which use a fluid to pump another fluid are known as ejectors or jetpumps. These pumping devices work on the principle of entrainment whereby a motive fluid is injected through a venturi creating a vacuum which draws in a secondary fluid—(fluid which is to be actually pumped), which is entrained with the motive fluid. Both fluids then are carried downstream for use. The disadvantages of such devices is the pressure limit which they may achieve in the secondary fluid to be pumped, which is approximately 125 psi as well as the relatively low pumping volume capacities of the ejector units.

A new pump has been developed which uses a motive fluid and a secondary fluid to be pumped, which overcomes the limitations earlier mentioned.

OBJECTS OF THE INVENTION

To provide a fluid pump which may be used to pump gaseous fluids as well as liquid fluids.

To provide a fluid pump which is capable of operating at higher efficiences than conventional ejectors.

To provide a fluid pump which is capable of pumping a secondary fluid at much higher pressures, such as in the order of thousands of pounds of pressure per square inch than that of conventional ejectors.

The preceeding objects of the invention are recognized by constructing a Fluid Exchange Pump.

SUMMARY OF THE INVENTION

As mentioned earlier, ejectors use a pressurized motive fluid to pump a secondary fluid by entraining the secondary fluid in the motive fluid. The motive fluid may be defined as that fluid which imparts an increase in pressure on the secondary fluid which is to be pumped. A portion of the energy in the motive fluid is imparted to the secondary fluid as they are both injected downstream and later used.

The general principle behind ejectors and jetpumps, is the using of a pressurized motive fluid to pump a secondary fluid. This forementioned principle is the same principle by which a Fluid Exchange Pump is based. The general operation of a Fluid Exchange Pump is as follows:

A secondary fluid-(fluid to be actually pumped) is introduced into a confinement chamber by means of an inlet port. Once the confinement chamber-(referred to as a "fluid exchange chamber") is sufficiently full, the inlet to the exchange chamber is isolated from the inlet port providing a closed environment for the secondary fluid. At another location of the Fluid Exchange Pump there exists a source of motive fluid existing at a higher pressure than that of the secondary fluid. This fluid may exist in either a static or moving state. The motive fluid source of the pressurized motive fluid, is introduced to the isolated secondary fluid so that the motive fluid source connects with the fluid exchange chamber, allowing the higher pressure motive fluid to flow into the lower pressure fluid exchange chamber. As this occurs, the secondary fluid is increased in pressure due to the motive fluid. The discharge outlet is now introduced to the fluid exchange chamber where the now pressurized secondary fluid will be transferred for use. The motive fluid forces the secondary fluid as it displaces the secondary fluid in the fluid exchange chamber, downstream with the motive fluid through the discharge outlet where the secondary fluid will eventually be used. Once enough of the secondary fluid has been removed from the fluid exchange chamber, the exchange chamber is isolated from the discharge outlet. At this point, the exhaust port is introduced to the exchange chamber where the pressurized motive fluid is removed from the fluid exchange chamber. Once the motive fluid is adequately removed from the fluid exchange chamber, secondary fluid is once again introduced to the fluid exchange chamber, as it was at the beginning of the pumping cycle, and the cycle may now be allowed to repeat itself continuously if desired.

The motive fluid and secondary fluid which are expelled through the discharge outlet may be used in its current state or may be separated so that the secondary fluid may be used and the motive fluid may be returned if desired for reuse in the Fluid Exchange Pump.

The drawings furnished here will illustrate the construction of the present invention in which the above advantages and features are clearly disclosed as well as others which will be readily understood from the following description:

BRIEF DESCRIPTION OF THE DRAWINGS

FIG. 9 is a side view of the apparatus depicted in FIGS. 5–8.

FIGS. 9A–9H illustrate the individual component parts of the Fluid Exchange Pump depicted in FIGS. 5–9.

FIGS. 23–26 illustrate another configuration and operating cycle of a Fluid Exchange Pump.

FIG. 27 is a side view of the apparatus depicted in FIGS. 23–26.

DETAILED DESCRIPTION OF THE INVENTION

Figure 2:
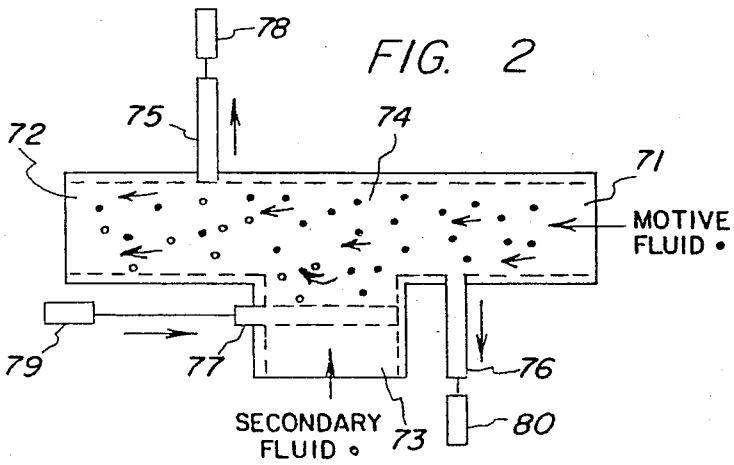
FIGS. 1–4 illustrate one configuration of a Fluid Exchange Pump.
Figure 4:
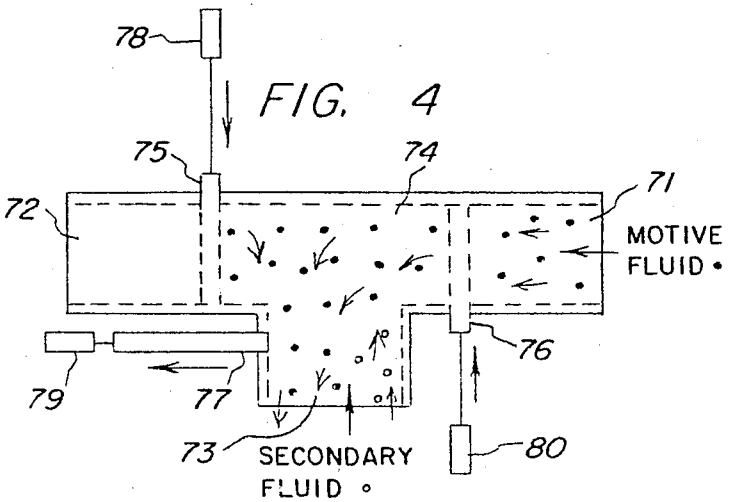
Figure 1:
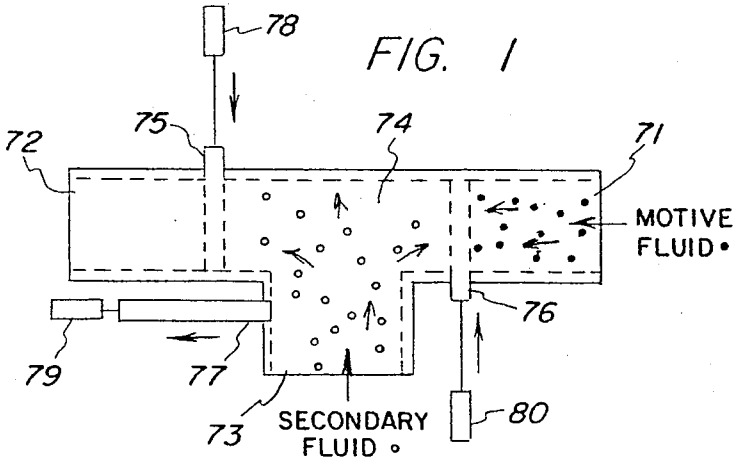
Figure 3:
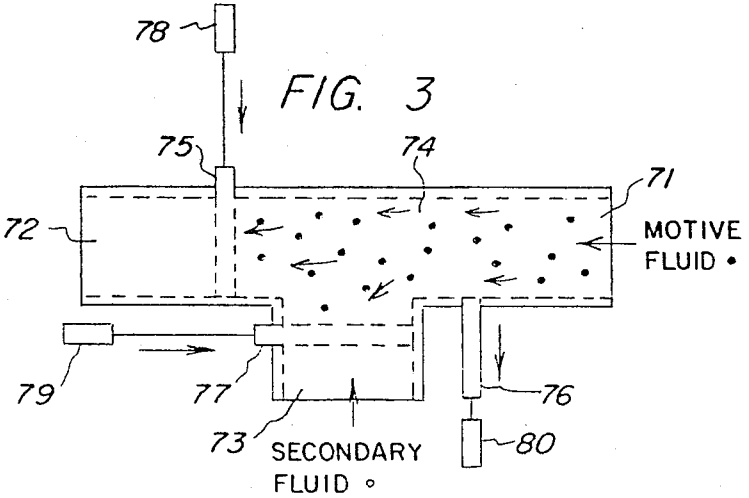

Referring to FIGS. 1–4 in greater detail, a Fluid Exchange Pump comprising: a motive fluid inlet 71; a fluid discharge outlet 72; a secondary fluid inlet 73; a fluid exchange chamber 74; a discharge outlet valve 75; a motive fluid inlet valve 76; a secondary fluid inlet valve 77; a discharge outlet valve actuator 78; a secondary fluid inlet valve actuator 79; a motive fluid inlet valve actuator 80; generally operates as follows: For my example, the motive fluid will be water and the secondary fluid will be air. FIG. 1—Secondary fluid is introduced into the fluid exchange chamber 74. Once the fluid exchange chamber 74 is adequately filled, the inlet valve 77 is closed. FIG. 2—Both the discharge outlet valve 75 and the motive fluid inlet valve 76 are opened as pressurized motive fluid is introduced into the fluid exchange chamber 74, displacing the existing secondary fluid as it does. The displaced secondary fluid is then forced downstream through the discharge outlet 72 by the flow of the motive fluid for its intended use. FIGS. 3&4—Once the secondary fluid is discharged from the outlet 72; the discharge outlet valve 75, and the motive fluid inlet valve 76 close. Now the secondary fluid inlet valve 77 is opened. As this occurs, the pressurized motive fluid inside the fluid exchange chamber 74 is expelled out the secondary fluid inlet 73 due to the internal pressure present as well as gravity, where it may be recirculated for reuse. As the motive fluid is drained, it is replaced with more secondary fluid and the cycle is now ready to repeat itself.

Another version of the pump may be illustrated as follows: For my example, the pump will serve as a water feed pump to a high-pressure steam boiler. The pump rests on top of the boiler lid and the fluid inlet 73, is exposed to the working insides of the boiler chamber. The original inlets 71&73 will now serve different functions than those previously described. The operation is as follows: With the discharge outlet valve 75 and the motive fluid inlet valve 77 in a closed position, the secondary fluid inlet valve 76 is opened allowing the secondary fluid (water) to enter the fluid exchange chamber 74. Once filled, the secondary fluid inlet valve 76 is closed. Now the motive fluid inlet valve 77 is opened. As this occurs, pressurized motive fluid (steam) enters the fluid exchange chamber 74, displacing the water present as it does and forcing it out the motive fluid inlet 73. Once the pressure inside the fluid exchange chamber 74 equalizes with the boiler pressure, the remaining water drains from the fluid exchange chamber 74 into the boiler. Now the fluid exchange chamber 74 is occupied with steam. The motive fluid inlet valve 77 is closed and the discharge outlet valve 75 is opened, allowing the pressurized steam to escape to the atmosphere. Once the steam is exhausted, the discharge outlet valve 75 is closed. The secondary inlet valve 76 is opened again as the secondary fluid is once again introduced to the fluid exchange chamber 74 and the cycle is now ready to repeat itself.

Figure 5:
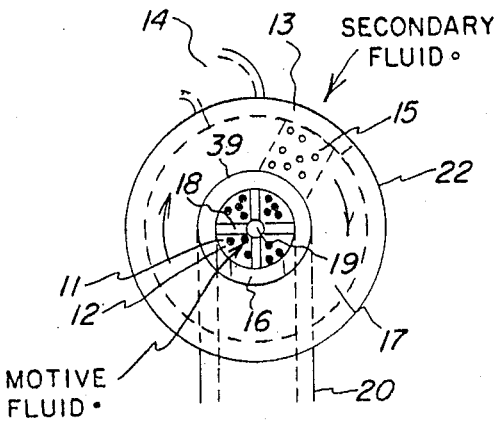
FIGS. 5–8 illustrate another configuration and operating cycle of a Fluid Exchange Pump.
Figure 6:
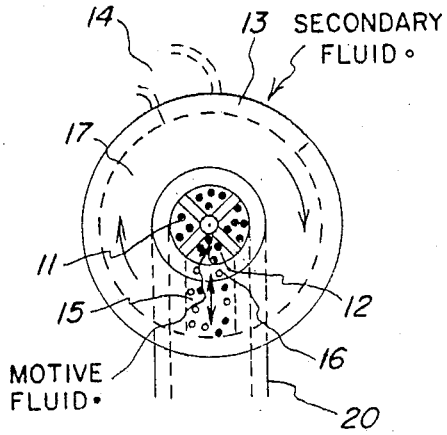
Figure 7:
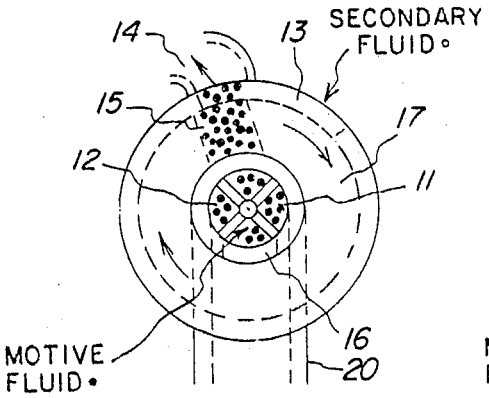
Figure 8:
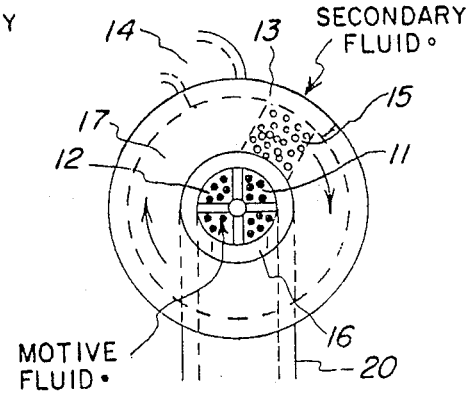
Figure 9I:
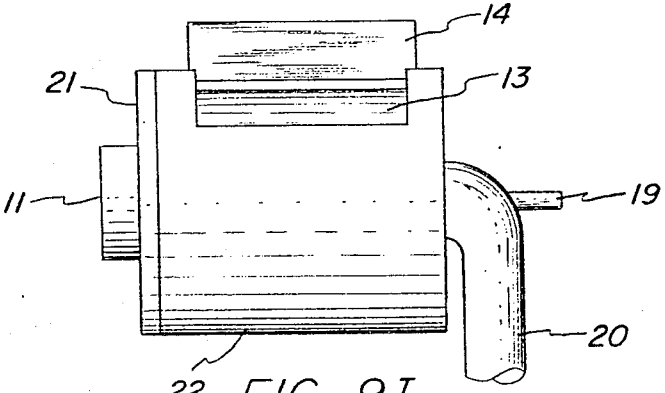
FIG. 9I illustrates a perspective side view of the Fluid Exchange Pump depicted in FIGS. 5–9.
Figure 9H:
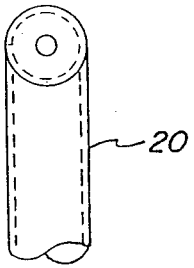
Figure 9G:
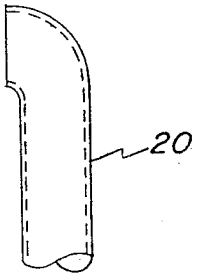
Figure 9J:
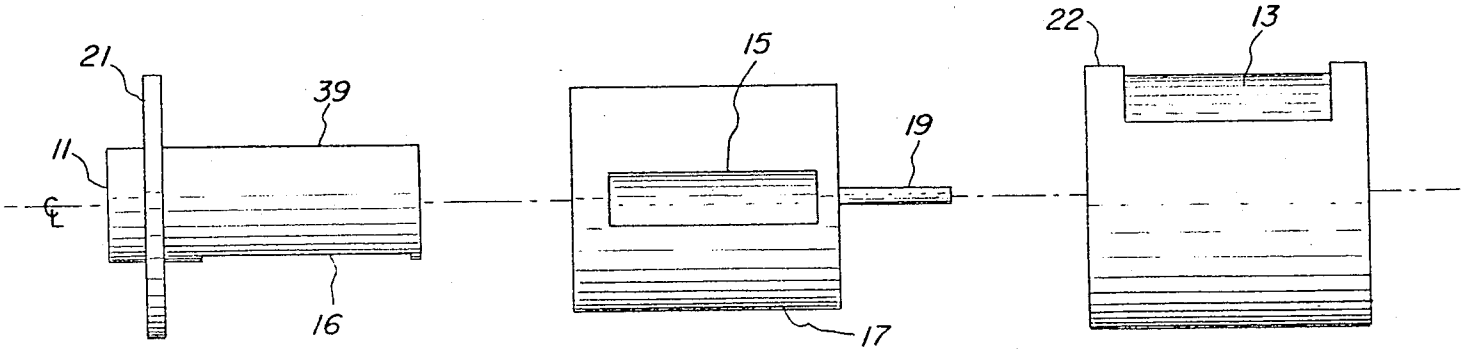
FIG. 9J illustrates a perspective assembly view of the individual component parts of the Fluid Exchange Pump depicted in FIGS. 5–9.

Referring to FIGS. 5–9H in greater detail, a Fluid Exchange Pump comprising: a motive fluid inlet 11; a fluid discharge outlet 12; a secondary fluid inlet 13; a fluid exhaust duct 14; a fluid exchange chamber 15; a fluid transfer passage 16; a rotor 17; a driveshaft coupling 18; a driveshaft 19; a fluid discharge duct 20; a fluid transfer tube 39; a transfer tube face plate 21; a pump housing 22; generally operates as follows: FIG. 5—With the shaft 19 rotating the rotor 17 in a clockwise direction, the fluid exchange chamber 15 is exposed to the secondary fluid inlet 13. Here secondary fluid is introduced into the fluid exchange chamber 15. FIG. 6—As the rotor 17 continues to rotate, the fluid exchange chamber 15 isolates itself from the secondary fluid inlet 13 and is exposed to the fluid transfer passage 16 which exposes the fluid exchange chamber 15 to the motive fluid inlet 11. As this occurs, pressurized motive fluid introduced at the motive fluid inlet 11 is introduced into the fluid exchange chamber 15. The higher pressure motive fluid displaces the lower pressure secondary fluid as turbulence and mixing occurs. As the motive fluid continues to flow into the fluid inlet 11, the secondary fluid is forced with the motive fluid downstream through the fluid discharge outlet 12 and the fluid discharge duct 20 for use, leaving the motive fluid occupying the fluid exchange chamber 15. FIG. 7—Continuing the rotor 17 rotation, the fluid exchange chamber 15 is isolated from the fluid transfer passage 16 and the fluid exhaust duct 14, is exposed to the fluid exchange chamber 15. Reaching the fluid exhaust duct 14, which exists on a portion of the secondary fluid inlet 13, the pressurized motive fluid is expelled from the fluid exchange chamber 15 due to the internal pressure of the fluid. Centrifugal force as well as gravity may also force the pressurized motive fluid from the fluid exchange chamber 15. This motive fluid is then carried away by the duct 14 where it may be recirculated for reuse if desired. FIG. 8—Continuing to rotate the rotor 17, the fluid exchange chamber 15 is once again exposed to the secondary fluid inlet 13 and the cycle is now ready to repeat itself. Just as in FIGS. 1–4, there were two different versions of the same pump, I will also show two versions of the type of pump illustrated in FIGS. 5–9. I will use the same water feed application for a boiler as that mentioned previously. The difference between the two pumping units is that in FIGS. 10–14, a separate fluid exhaust outlet 32 is provided instead of incorporating it with the secondary fluid inlet 31, and the previously existing fluid discharge outlet 12 and fluid duct 20 are deleted.

Figure 10:
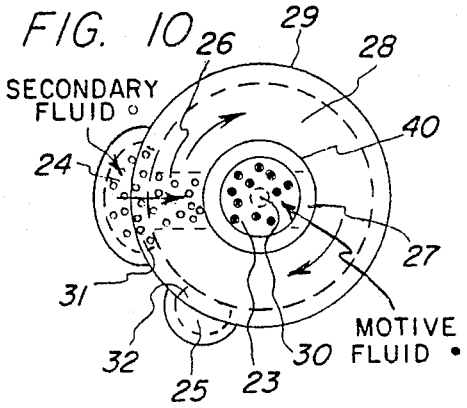
FIGS. 10–13 illustrate another configuration and operating cycle of a Fluid Exchange Pump.
Figure 11:
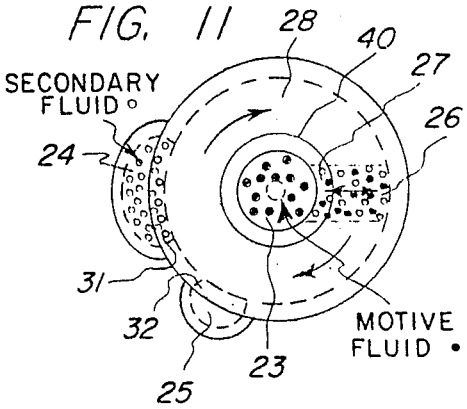
Figure 12:
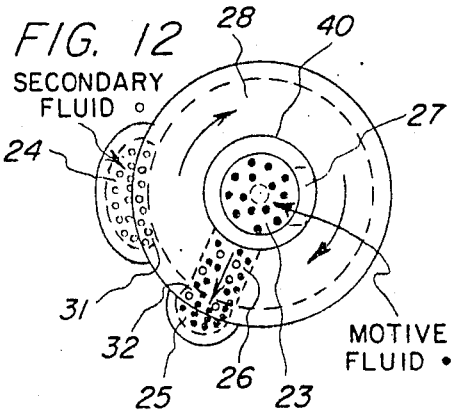
Figure 13:
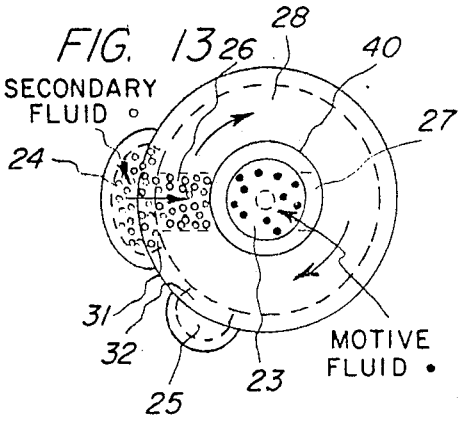
Figure 14:
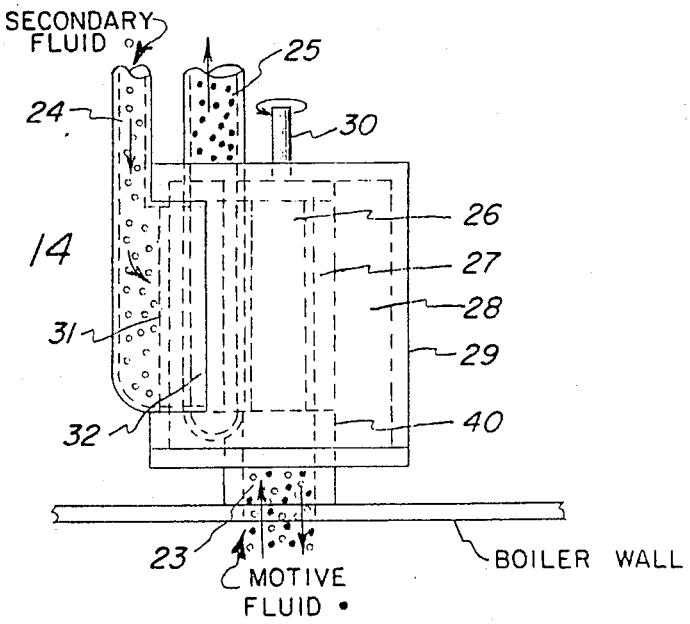
FIG. 14 is a side view of the apparatus depicted in FIGS. 10–13.

Referring to FIGS. 10–14 in greater detail, a Fluid Exchange Pump comprising: a pressurized motive fluid inlet 23; a secondary fluid inlet duct 24; a fluid exhaust duct 25; a fluid exchange chamber 26; a fluid transfer passage 27; a rotor 28; a pump housing 29; a driveshaft 30; a secondary fluid inlet 31; a fluid exhaust outlet 32; a fluid transfer tube 40; operates as follows: FIG. 10—With the driveshaft 30 rotating the rotor 28 in a clockwise direction, the fluid exchange chamber 26 is exposed to the secondary fluid inlet 31, and the secondary fluid (water) is introduced into the fluid exchange chamber 26. FIG. 11—Continuing rotation of the rotor 28, the fluid exchange chamber 26 becomes isolated from the secondary fluid inlet 31, and is exposed to the fluid transfer passage 27 which exposes the fluid exchange chamber 26 to the motive fluid inlet 23 As this occurs, pressurized motive fluid (steam), introduced at the motive fluid inlet 23, is introduced into the fluid exchange chamber 26. The higher pressure motive fluid displaces the lower pressure secondary fluid as turbulence and mixing occurs, forcing the existing secondary fluid (water) out the motive fluid inlet 23. Once the pressure within the fluid exchange chamber 26 is equalized with that of the boiler, the remaining water drains from the fluid exchange chamber 26 into the boiler. Now the fluid exchange chamber 26 is occupied with steam. FIG. 12—As the rotor 28 continues to rotate, the fluid exchange chamber 26 is isolated from the fluid transfer passage 27 and is exposed to the fluid exhaust outlet 32 where the motive fluid (steam) is expelled, due to internal pressure. Centrifugal force as well as gravity may also force the pressurized motive fluid from the fluid exchange chamber 26. The motive fluid is then carried away by the fluid exhaust duct 25. FIG. 13—Continuing rotation of the rotor 28 exposes the fluid exchange chamber 26 to the secondary fluid inlet 31 again, and the cycle is now ready to repeat itself.

FIGS. 15–18 differ from that of FIGS. 5–9 in that a separate fluid exhaust outlet 35 is provided such as the one previously illustrated in FIGS. 10–14, multiple fluid exchange chambers 36 exist, and the motive fluid is not introduced into the pump in an axial direction but rather radially along the length of the pump. For my example, only the operation of one fluid exchange chamber will be followed.

Figure 15:
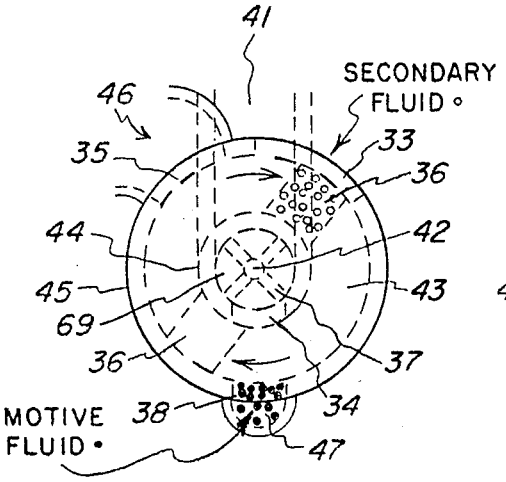
FIGS. 15–18 illustrate another configuration and operating cycle of a Fluid Exchange Pump.
Figure 16:
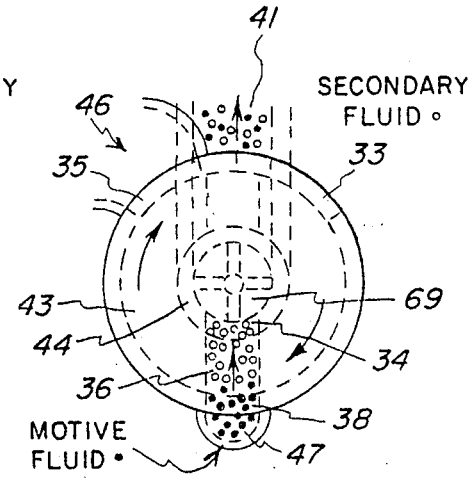
Figure 17:
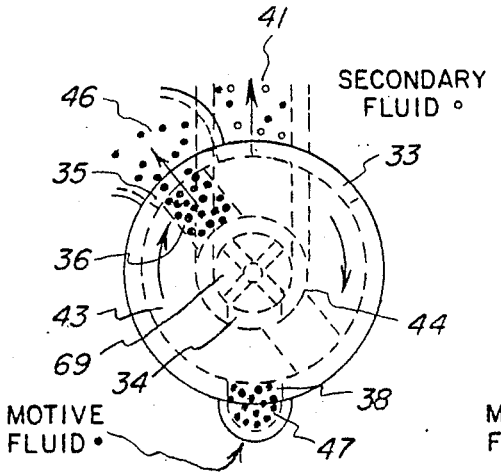
Figure 18:
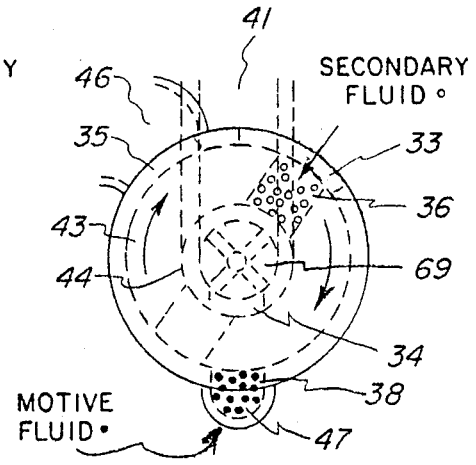

Referring to FIGS. 15–18 in greater detail, a Fluid Exchange Pump comprising: A secondary fluid inlet 33; a fluid transfer passage 34; a fluid exhaust outlet 35; a fluid exchange chamber 36; a driveshaft coupling 37; a pressurized motive fluid inlet 38; a discharge outlet duct 41; a driveshaft 42; a rotor 43; a fluid transfer tube 44; a pump housing 45; a fluid exhaust duct motive fluid inlet duct 47; and a fluid discharge outlet 69; operates as follows: FIG. 15—With the driveshaft 42 rotating the rotor 43 in a clockwise direction, the fluid exchange chamber 36 is exposed to the secondary fluid inlet 33 and a secondary fluid is introduced into the fluid exchange chamber 36. FIG. 16—Continuing rotation of the rotor 43, the fluid exchange chamber 36 becomes isolated from the secondary fluid inlet 33 and is exposed to the fluid transfer passage 34 and the pressurized motive fluid inlet 38 along the length of the pump. As this occurs, pressurized motive fluid is introduced into one end of the fluid exchange chamber 36. The motive fluid forces the secondary fluid within the fluid exchange chamber 36, out through the fluid transfer passage 34 where it is expelled through the fluid discharge outlet 69 for use, leaving the motive fluid now occupying the fluid exchange chamber 36. FIG. 17—Continuing rotation of the rotor 43, the fluid exchange chamber 36 is isolated from the fluid transfer passage 34 and the motive fluid inlet 38, and is exposed to the fluid exhaust outlet 35 where the motive fluid is expelled due to the internal pressure present. Centrifugal force, as well as gravity may also force the pressurized motive fluid from the fluid exchange chamber 36. The motive fluid is then carried away by the fluid exhaust duct 41. FIG. 18—Continuing rotation of the rotor 43 exposes the fluid exchange chamber 36 to the secondary fluid inlet 33 again and the cycle is now ready to repeat itself. The 2nd fluid exchange chamber 36 operates the same as the one just described. FIGS. 19–22 differ from that of FIGS. 5–9 in that the motive fluid is not introduced into the pump in an axial direction, but rather radially along the length of the pump such as the one previously illustrated in FIGS. 15–18, and the pressurized motive fluid inlet 49 is not directly in communication with the fluid transfer passage 51 as are the previous examples when the fluid exchange chamber 48 is exposed to the fluid transfer passage 51. In this example, I will say that the secondary fluid is air and the motive fluid is water.

Figure 19:
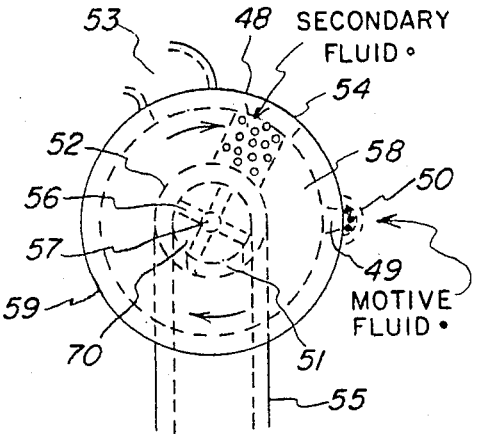
FIGS. 19–22 illustrate another configuration and operating cycle of a Fluid Exchange Pump.
Figure 20:
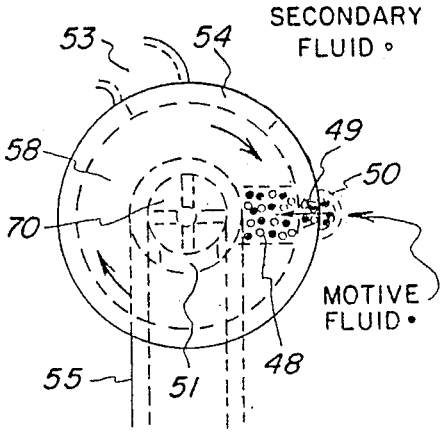
Figure 21:
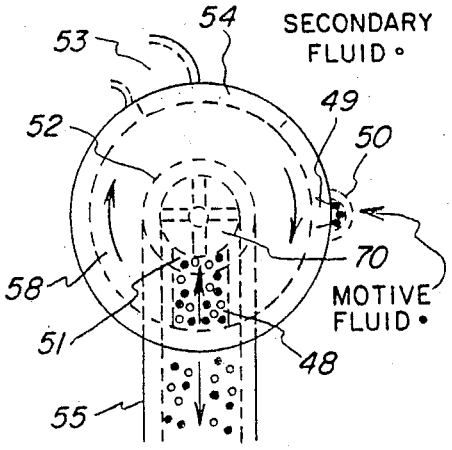
Figure 22:
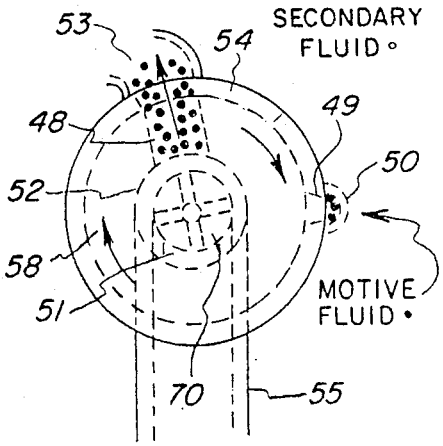

Referring to FIGS. 19–22 in greater detail, a Fluid Exchange Pump comprising: A fluid exchange chamber 48; a pressurized motive fluid inlet 49; a motive fluid inlet duct 50; a fluid transfer passage 51; a fluid transfer tube 52; a fluid exhaust duct 53; a secondary fluid inlet 54; a discharge outlet duct 55; a driveshaft coupling 56; a driveshaft 57; a rotor 58; a pump housing 59; a fluid discharge outlet 70; operates as follows: FIG. 19—With the driveshaft 57 rotating the rotor 58 in a clockwise direction, the fluid exchange chamber 48 is exposed to the secondary fluid inlet 54 and a secondary fluid is introduced into the fluid exchange chamber 48. FIG. 20—Continuing rotation of the rotor 58, the fluid exchange chamber 48 becomes isolated from the secondary fluid inlet 54 and is exposed to the pressurized motive fluid inlet 49, along the length of the pump. As this occurs, pressurized motive fluid is introduced into the fluid exchange chamber 48 along the length of the pump. This causes the pressure of the secondary fluid within the fluid exchange chamber to increase. FIG. 21—As the rotor 58 continues to rotate, the fluid exchange chamber 48 becomes isolated from the pressurized motive fluid inlet 49, and is exposed to the fluid transfer passage 51. Now the secondary fluid (air) and part of the motive fluid is forced out of the fluid exchange chamber 48, through the fluid transfer passage 51, and into the fluid transfer tube 44, where it is expelled through the discharge outlet 70 and duct 41 for use. Most of the heavier water is left behind to occupy the fluid exchange chamber 48. FIG. 22—Continuing rotation of the rotor 58, the fluid exchange chamber 48 is isolated from the fluid transfer passage 51 and is exposed to the fluid exhaust duct portion of the secondary fluid inlet 53 where the motive fluid is expelled from the fluid exchange chamber 48 due to internal pressure. Centrifugal force as well as gravity may also force the pressurized motive fluid from the fluid exchange chamber 48. Further rotation of the rotor 58 would bring the fluid exchange chamber 48, to the secondary fluid inlet 54 again so that the cycle may be repeated. FIGS. 23–27 differ from that of FIGS. 5–9 in that a separate fluid exhaust outlet 63 is provided such as those previously illustrated, and there is no fluid transfer tube or passage as previously seen.

Referring to FIGS. 23–27 in greater detail, a Fluid Exchange Pump comprising: A secondary fluid inlet 60; a fluid exchange chamber 61; a motive fluid inlet 62; a fluid exhaust outlet 63; a fluid exhaust outlet duct 64; a rotor 65; a driveshaft 66; a pumping housing 67; a fluid discharge outlet 68; operates as follows: FIG. 23—With the driveshaft 66 rotating the rotor 65 in a clockwise direction, the fluid exchange chamber 61 is exposed to the secondary fluid inlet 60, and secondary fluid is introduced into the fluid exchange chamber 61. FIG. 24—Continuing rotation of the rotor 65, the fluid exchange chamber 61 is isolated from the secondary fluid inlet and is exposed to the pressurized motive fluid inlet 62. As this occurs, pressurized motive fluid is introduced into one end of the fluid exchange chamber 61. The motive fluid forces the secondary fluid within the fluid exchange chamber 61, out the fluid discharge outlet 68 for use, leaving pressurized motive fluid within the fluid exchange chamber 61. FIG. 25—Continuing rotation of the rotor 65, the fluid exchange chamber 61 is isolated from the pressurized motive fluid inlet 62 and is exposed to the fluid exhaust outlet 63 where the motive fluid is expelled out the fluid exhaust outlet 63 and the fluid exhaust duct due to internal pressure. Centrifugal force as well as gravity may also force the pressurized motive fluid from the fluid exchange chamber 61. FIG. 26—Continuing rotation of the rotor 65, the fluid exchange chamber 61 is exposed again to the secondary fluid inlet 60 where the cycle is ready to be repeated.

As was illustrated in the previous examples, fluids entering and leaving the fluid exchange chamber of the pump may do so under such forces as pressure, gravity, momentum etc. depending on the operating conditions. The chambers and openings within the pump may be designed for any shape or quantity desired. The seals between such parts as the rotors or valves are close enough to prevent any unwanted leakage. Restrictive membranes or devices may be used at such locations as the fluid transfer passage or the fluid discharge outlet so that only a secondary fluid is allowed to pass through while restricting the passage of the motive fluid, as well as separating means which may be provided for the discharged outlet fluid of the pump if required. The pumping of the secondary fluid does not take place continuously, but occurs every time a fluid exchange chamber is pressurized during operation.

Ejectors and jetpumps pump secondary fluid using a motive fluid by means of continuous entrainment, while a Fluid Exchange Pump also uses a motive fluid to pump a secondary fluid, but not by entrainment however, but by an exchange of one fluid for the other. The secondary fluid may go in at atmospheric or under a greater pressure into the fluid exchange chamber. The actuating means for valves and driveshafts of the pumps may be any of the many methods which are obvious to anyone who is knowledgable in the art, such as mechanically, electrically etc.

All of the motive and secondary fluid is not required to be removed from the fluid exchange chamber during the operation cycle of the pump as long as the pump may still adequately function as desired. A separate fluid exhaust outlet is not necessary, if it is acceptable to allow the pressurized motive fluid to be expelled out another outlet means such as the secondary fluid inlet, as previously illustrated. In the rotating versions previously depicted of the pump in the drawings, the shaded areas of the pumps illustrate the position of the secondary fluid inlets, fluid exchange chambers, fluid transfer passages, and the fluid exhaust outlets. The pumps themselves may take on any combination of the prior depicted configurations or any configuration appropriate for their application.

The foregoing detailed description has been given for clearness of understanding only and no unnecessary limitations should be understood therefrom as modifications will be obvious to those skilled in the art.

What is claimed:

1. A fluid exchange pump comprising:

a first cylindrical conduit having inlet and outlet means and a least one arcuate port therein and radial base means;

a longitudinally chambered cylindrical body enveloping a portion of said conduit and adapted for rotation thereabout, said body containing therein at least one arcuate radial chamber, said radial chamber having an inner port and an outer port in respective slidable registry with said conduit and an outer housing, said body having an open end and a coaxially ported base disposed opposite said radial base means, said outer housing fixedly coupled to said conduit by said radial base means and enveloping said cylindrical body so that said cylindrical body will rotate about said conduit and within said outer housing, said outer housing having arcuate ports, said arcuate ports comprising at least one outlet port and at least one inlet port; and means for rotating said cylindrical body relative to said conduit, whereby when said cylindrical body is caused to rotate between said fixed conduit and said outer housing, said chamber inner and outer ports are intermittently aligned and disaligned with the arcuate ports of said conduit and said outer housing thereby allowing a sequence of admitting a secondary fluid to said chamber, isolating said secondary fluid by rotation of said chamber to then expose it to a motive fluid, pumping said secondary fluid and exhausting said motive fluid together from the filled chamber, and accomplishing the aforesaid sequence continuously by action of the rotary motion aforesaid.

* * * * *